US008540528B2

(12) United States Patent
Wada et al.

(10) Patent No.: US 8,540,528 B2
(45) Date of Patent: Sep. 24, 2013

(54) FLAT CABLE ELECTRICAL CONNECTOR

(75) Inventors: Shuntaro Wada, Tokyo (JP); Hidehiro Tsukumo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 294 days.

(21) Appl. No.: 13/043,916

(22) Filed: Mar. 9, 2011

(65) Prior Publication Data

US 2011/0237106 A1 Sep. 29, 2011

(30) Foreign Application Priority Data

Mar. 26, 2010 (JP) ..... 2010-073505

(51) Int. Cl.
*H01R 13/62* (2006.01)

(52) U.S. Cl.
USPC ..... 439/329

(58) Field of Classification Search
USPC ..... 439/260, 329, 492, 494, 499
See application file for complete search history.

(56) References Cited

U.S. PATENT DOCUMENTS

| | | | | |
|---|---|---|---|---|
| 7,318,737 | B2 * | 1/2008 | Yokoyama | 439/260 |
| 7,347,720 | B2 * | 3/2008 | Takashita | 439/495 |
| 7,604,499 | B2 * | 10/2009 | Sunaga | 439/495 |

FOREIGN PATENT DOCUMENTS

| | | | |
|---|---|---|---|
| JP | 2004-039321 | A | 2/2004 |
| JP | 4192203 | B1 | 12/2008 |
| JP | 2009-199766 | A | 9/2009 |

* cited by examiner

*Primary Examiner* — Vanessa Girardi
(74) *Attorney, Agent, or Firm* — Kubotera & Associates LLC

(57) ABSTRACT

An electrical connector for connecting a flat conductive member includes a housing including a receiving section for receiving the flat conductive member in a first direction and a terminal arranged in the housing. The terminal includes a first contact section for contacting with the flat conductive member, a second contact section for contacting with the flat conductive member, an extending arm portion, and a first flexible contact arm portion extending from the extending arm portion toward the second contact section. The first contact section is disposed at a distal end portion of the first flexible contact arm portion. The electrical connector further includes a pressing portion for contacting the flat conductive member with the first contact section and the second contact section.

8 Claims, 7 Drawing Sheets

FLAT CABLE ELECTRICAL CONNECTOR

BACKGROUND OF THE INVENTION AND RELATED ART STATEMENT

The present invention relates to an electrical connector for connecting a flat conductive member.

Patent Reference has disclosed a conventional electrical connector for connecting a flat conductive member. The conventional electrical connector has a plurality of terminals with a plurality of contact sections. In the conventional electrical connector, the contact sections are formed at the terminals to contact with the flat conductive member, so that the terminals can securely and stably contact with the flat conductive member.

Patent Reference Japanese Patent Publication No. 4192203

In the conventional electrical connector described in Patent Reference, each of the terminals includes a first flexible contact arm portion (a rear contact beam) that extends backward, i.e., a direction of pulling out the flat conductive member, from a lower part of a basal section, which extends in a vertical direction (i.e., a direction orthogonal to a surface of the flat conductive member). Each of the terminals further includes a second flexible contact arm portion that extends backwards in parallel to the first contact arm in the vertical direction at a position of the basal section.

In the conventional electrical connector described in Patent Reference, the first contact arm includes a front contact section that protrudes upward at a rear end thereof for contacting with the flat conductive member. The second contact arm has a rear-side portion that extends diagonally upward to the same position as the front contact section in the vertical direction, and includes a rear contact section that protrudes upward for contacting with the flat conductive member.

Accordingly, each of the terminals includes two contact sections, i.e., the front contact section of the first contact arm and the rear contact section of the second contact arm. The front contact section and the rear contact section are provided away from each other in the front-and-back direction, and are situated at the same height level in the vertical direction.

According to the conventional electrical connector disclosed in Patent Reference, when an actuator presses the flat conductive member downward towards the front contact section and the rear contact section after inserting the flat conductive member frontward, the front contact section and the rear contact section elastically displace and contact with a corresponding circuit section, which is formed on a lower face of the flat conductive member, with a certain contact pressure.

In the conventional electrical connector of the type described above, it has been required to reduce a dimension in a direction orthogonal to a surface of the flat conductive member. In the conventional electrical connector disclosed in Patent Reference, the two contact arms, i.e., the first contact arm and the second contact arm, are formed in parallel to each other at positions that are away from each other in the vertical direction. Accordingly, it is necessary to provide a space to allow the first contact arm and the second contact arm to elastically displace downward. As a result, it is difficult to reduce a dimension of the terminals and a dimension of the electrical connector in the vertical direction, which is orthogonal to the flat conductive member.

In view of the problems described above, an object of the present invention is to provide an electrical connector for a flat conductive member. In the electrical connector of the present invention, it is possible to reduce a size of terminal and a size of the electrical connector, even when the terminal includes a plurality of contact sections to securely contact with the flat conductive member, thereby ensuring stable contact.

Further objects and advantages of the invention will be apparent from the following description of the invention.

SUMMARY OF THE INVENTION

In order to attain the objects described above, according to a first aspect of the present invention, an electrical connector for a flat conductive member includes a housing that has a receiving section, to which a connecting portion of the flat conductive member formed at a front end thereof is inserted forward, and a plurality of terminals arranged and held in the housing in a direction orthogonal to a flat surface of a sheet metal thereof while maintaining the flat surface.

According to the first aspect of the present invention, at least one of the terminals has a plurality of contact sections to contact with one surface of the flat conductive member, and an extending arm portion that extends in the front-and-back direction so as to be away from the one face of the flat conductive member in a direction orthogonal to the flat conductive member relative to the contact sections. The contact sections are provided at different positions in the front-and-back direction.

According to the first aspect of the present invention, one of the contact sections is formed at a distal end portion of a flexible contact arm portion that extends from the extending arm portion toward the other of the contact sections. The housing or a member attached to the housing includes a pressing portion to contact the flat conductive member with the contact sections of the one of the terminals.

According to the first aspect of the present invention, the contact sections are provided at different positions in the front-and-back direction. Among two of the contact sections, one of the contact sections is formed at the distal end portion of the flexible contact arm portion that extends from the extending arm portion toward the other of the contact sections.

Further, the contact arm that has one of the contact sections formed thereon is provided being behind/in front of the other of the contact sections within a range not to overlap with the other of the contact sections in the front-and-back direction. Accordingly, it is possible to provide the both contact sections at the positions that are close to each other within the range that overlaps in the direction orthogonal to the flat conductive member, or even if there is no overlaps. As a result, it is possible to reduce the dimensions of the terminals in the direction orthogonal to the flat conductive member and in turn the dimension of the electrical connector.

According to a second aspect of the present invention, the contact arm, on which the one of the contact sections is formed, may be preferably provided at the same position as the other of the contact sections in the direction orthogonal to the flat conductive member. As a result, it is possible to further reduce the dimensions of the terminals in the direction orthogonal to the flat conductive member and in turn the dimension of the electrical connector.

According to a third aspect of the present invention, the other of the contact sections may be preferably formed at a distal end portion of a flexible contact arm portion that extends towards the one of the contact sections.

According to a fourth aspect of the present invention, it may be configured such that the pressing portion preferably presses the flat conductive member at a position between the one of the contact sections and the other of the contact sections in the front-and-back direction. With the configuration, when the pressing portion presses the flat conductive member at a position between one of the contact sections and the other of the contact sections in the front-and-back direction, a distance from a position where the pressing portion presses the flat conductive member to the one of the contact sections and the other of the contact sections becomes substantially the same. Therefore, it is possible to make a contact pressure of the flat conductive member against the one contact section and the other contact section substantially the same, thereby making it possible to improve contact reliability.

According to a fifth aspect of the present invention, the pressing portion may be formed of a pressing member that can move between an open position that enables insertion of the flat conductive member and a closed position that enhances the contact pressure of the flat conductive member against the contact sections of the terminals. Further, the pressing member may press the flat conductive member towards the contact sections at the closed position. With the pressing member, it is possible to easily insert the flat conductive member with a little insertion force at the open position.

According to a fifth aspect of the present invention, the electrical connector may further include a movable member, which can move between the open position that enables insertion of the flat conductive member and the closed position that enhances the contact pressure of the flat conductive member against the contact sections of the terminals.

Further, each of the terminals may have a stationary arm portion, a movable arm portion and a joint section to join the stationary arm portion and the movable arm portion at a middle position in the front-and-back direction. The stationary arm portion and the movable arm are provided in parallel to each other in the front-and-back direction.

Further, the stationary arm portion is secured onto the housing, and has a support section to support a cam section formed on the movable member at a frontal end side thereof and a contact section at a rear end side thereof. The movable arm portion has a pressed section at the front end side and a pressing section as a pressing member at the rear end side. The movable arm portion may be configured such that, when the movable member moves from the open position to the closed position, the pressed section pivotally displaces by an angle being pressed by the cam section of the movable member and the pressing member presses the flat conductive member towards the contact sections.

According to a fifth aspect of the present invention, the electrical connector may further include a movable member, which can move between the open position, which enables insertion of the flat conductive member, and the closed position, which enhance the contact pressure of the flat conductive member against the contact sections of the terminals.

Further, the terminal may have a stationary arm portion and a movable arm portion, which extend in the front-and-back direction in parallel to each other. The terminal may further include a joining section to join the stationary arm portion and the movable arm portion at a middle position in the front-and-back direction.

Further, the stationary arm portion may be secured on the housing and has a support section to support the cam section formed at the movable member at a front end side and a pressing section as a pressing member at a rear end side. The movable arm portion may have a pressed section at the front end side and a contact section on the rear end side. The movable arm portion may be configured such that, when the movable member moves from the open position to the closed position, the movable arm portion pivotally displaces being pressed by the cam section of the movable member and the pressing section presses the flat conductive member against the contact section with the counterforce.

As described above, according to the present invention, in the terminals, the two contact sections among the contact sections are provided at different positions in the front-and-back direction. Further, one of the contact sections is formed at the distal end portion of the flexible contact arm portion that extends towards the other of the contact sections. Accordingly, it is possible to provide the contact arm, in which one of the contact sections is formed, within a range where there is no overlap with the other of the contact sections in the front-and-back direction.

Further, the terminals have the contact sections for securing the contact between the flat conductive member and the terminals and securing the stability of the contacts. The contact sections are disposed at positions that are close to each other in the direction orthogonal to the flat conductive member. Accordingly, it is possible to reduce the dimensions of the terminals in the direction orthogonal to the flat conductive member and the dimension of the electrical connector.

BRIEF DESCRIPTION OF THE DRAWINGS

FIGS. 1(A) and 1(B) are perspective views showing an electrical connector for a flat conductive member according to a first embodiment of the present invention, wherein FIG. 1(A) is a perspective view showing the electrical connector in a state that a pressing member is situated at an open position and FIG. 1(B) is a perspective view showing the electrical connector in a state that the pressing member is situated at a closed position;

FIGS. 2(A) to 2(C) are sectional views showing the electrical connector for the flat conductive member taken along a line II-II in FIGS. 1(A) and 1(B) according to the first embodiment of the present invention, wherein FIG. 2(A) is a sectional view showing the electrical connector before the flat conductive member is inserted into the electrical connector, FIG. 2(B) is a sectional view showing the electrical connector when the flat conductive member is completely inserted into the electrical connector, and FIG. 2(C) is a sectional view showing the electrical connector in the state that the pressing member is situated at the closed position after the flat conductive member is inserted into the electrical connector;

DETAILED DESCRIPTION OF THE PREFERRED EMBODIMENTS

Hereunder, embodiments of the present invention will be described with reference to the accompanying drawings.

First Embodiment

Figure 1A:
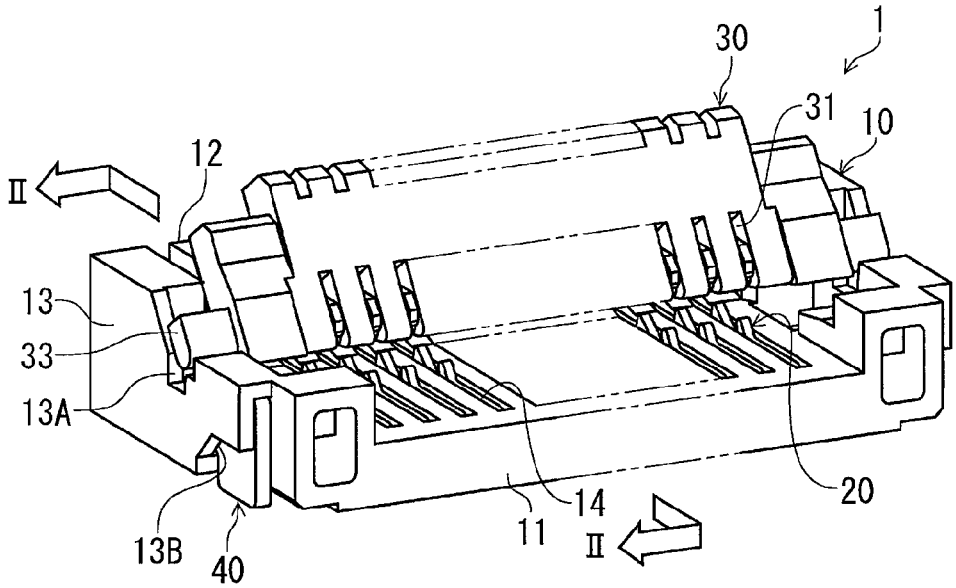
Figure 1B:
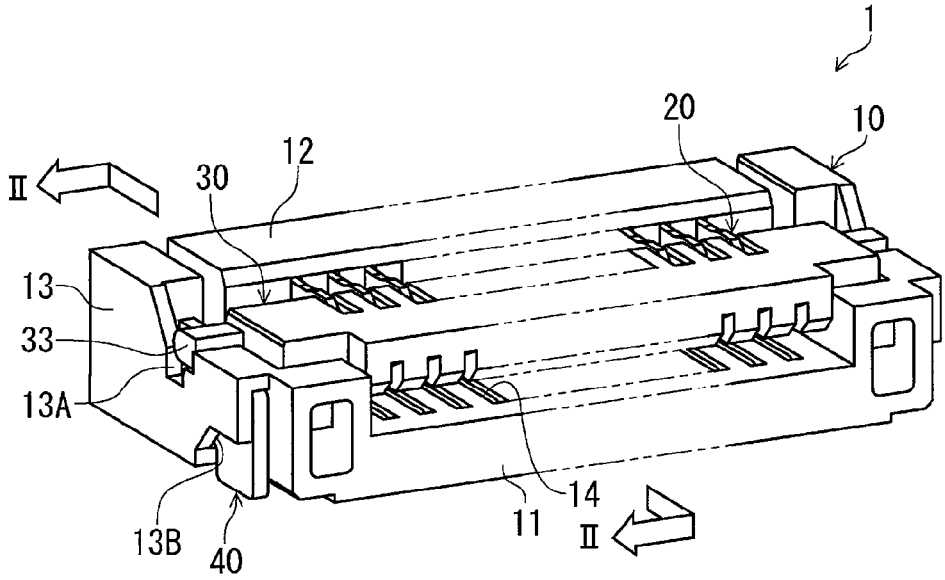

A first embodiment of the present invention will be explained. FIGS. 1(A) and 1(B) are perspective views showing an electrical connector 1 for a flat conductive member F according to the first embodiment of the present invention. More specifically, FIG. 1(A) is a perspective view showing the electrical connector 1 in a state that a pressing member 30 is situated at an open position and FIG. 1(B) is a perspective view showing the electrical connector in a state that the pressing member 30 is situated at a closed position.

Figure 2A:
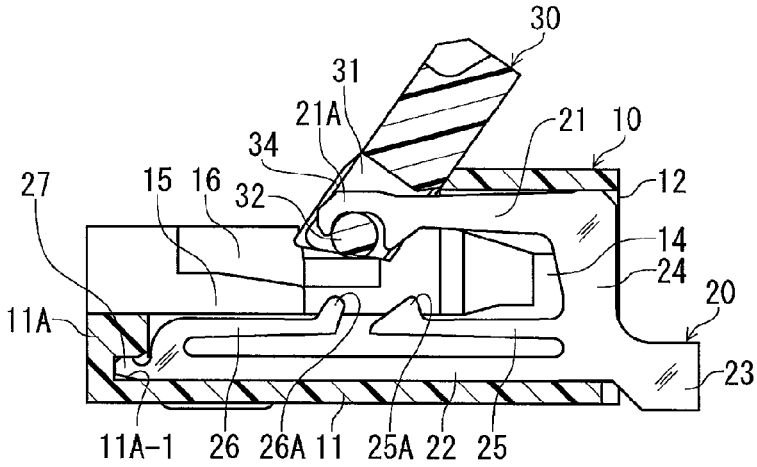
Figure 2B:
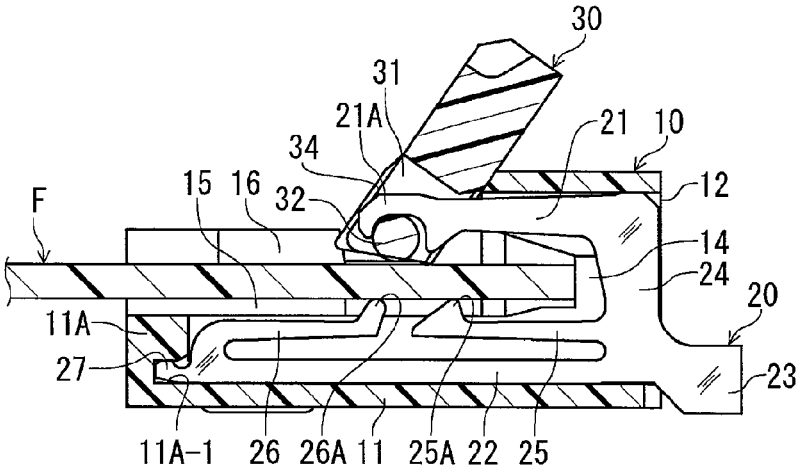
Figure 2C:
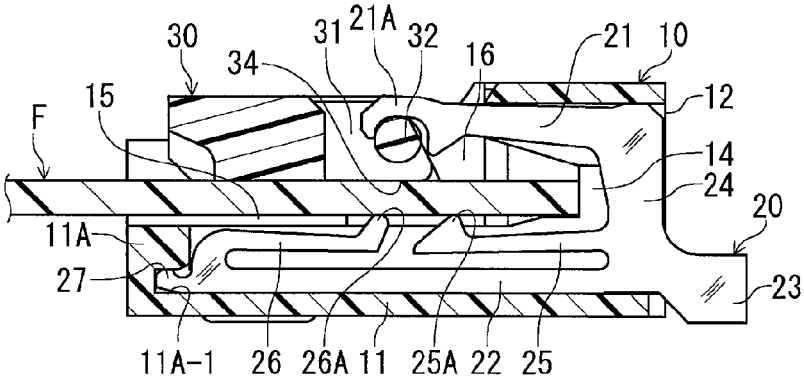

FIGS. 2(A) to 2(C) are sectional views showing the electrical connector 1 for the flat conductive member F taken along a line II-II in FIGS. 1(A) and 1(B) according to the first embodiment of the present invention. More specifically, FIG. 2(A) is a sectional view showing the electrical connector 1 before the flat conductive member F is inserted into the electrical connector 1, FIG. 2(B) is a sectional view showing the electrical connector 1 when the flat conductive member F is completely inserted into the electrical connector 1, and FIG. 2(C) is a sectional view showing the electrical connector 1 in the state that the pressing member 30 is situated at the closed position after the flat conductive member F is inserted into the electrical connector 1.

In the embodiment, the electrical connector 1 for the flat conductive member F (hereinafter may be simply referred to as the connector 1) is to be disposed on a circuit board (not illustrated) and to insert a connecting part of the flat conductive member F, e.g., a FPC, into the front side thereof (right side in FIGS. 2(A) to 2(C)) for electrical connection between the flat conductive member and the circuit board. In FIGS. 1(A) and 1(B), a middle part of the connector 1 in the longitudinal direction, i.e., a terminal arrangement direction, is indicated with a phantom line, and detailed illustration in the range is omitted.

The connector 1 includes a housing 10 that has an outer shape of a generally rectangular prism and is made of an electrically insulating material, e.g. synthetic resin, a plurality of terminals 20 made of metal, which are arranged and held at equal intervals in the housing 10, a pressing member 30 made of an electrically insulating material, e.g. synthetic resin, which is to be rotatably supported with the housing 10 and the plurality of terminals 20, and a securing hardware 40 made of metal, which is held by the housing 10 at the both ends of the housing 10 in the terminal arrangement direction.

The flat conductive member F shown in FIGS. 2(B) and 2(C) has a corresponding circuit section on the lower face, which is to be connected to the terminals 20, at the positions that respectively correspond to the plurality of terminals 20 in the terminal arrangement direction (in a direction orthogonal to the paper surface in FIGS. 2(B) and 2(C)) upon insertion into the connector 1.

As shown in FIGS. 1(A)-1(B) and 2(A)-2(C), the housing 10 includes a bottom wall 11, a front wall 12 that is provided above the bottom wall 11 on a flat conductive member insertion destination side, and side walls 13 (not illustrated in FIGS. 2(A) to 2(C)) that extend upward from the bottom wall 11 at the both ends of the housing 10 in the terminal arrangement direction of the housing 10. The housing 10 has terminals holding grooves 14 to hold the terminals 20, which extend in the front-and-back direction and are provided at equal intervals along the terminal arrangement direction of the housing 10. The housing 10 composes an open space with the rear part thereof being cut out and opened upward over the terminal arrangement range.

As shown in FIGS. 2(A) to 2(C), each of the terminal holding grooves 14 extends over the bottom 11 of the housing 10 and the front wall 12 that extends above the bottom wall 11 on the front side thereof, has a generally L-shape as a whole, and is made to have a slit-like shape that extends parallel to the paper surface. Each of the terminal holding grooves 14 is provided through in the front-and-back direction except at the rear end of the bottom wall 11.

In addition, each terminal holding groove 14 is covered with a rear wall 11A formed at the rear end of the bottom wall 11 and is not provided through on the rear side. On an inner face of the rear wall 11A, there is formed a holding hole 11A-1 to hold a section 27 of each terminal 20 to be held.

As shown in FIGS. 1(A) and 1(B), each of the side walls 13 is dented on the upper edge in the middle of the front-and-back direction, and has an end shaft housing section 13A as space to freely rotatably house an end shaft section 33 of the pressing member 30, which will be described later. In addition, each side wall 13 has a slit-like securing hardware holding groove 13B to hold the securing hardware 40, being opened on the rear side of the side wall 13.

As shown in FIGS. 2(A) to 2(C), there is an open space formed at the upper half part of the rear half part of the housing 10, so as to be provided through the terminal arrangement range and opened upward as described above. A lower half part of the open space forms receiving space 15 to receive the flat conductive member F from the rear side. In addition, the upper half part of the open space forms movable member moving space 16 to allow the movement of the pressing member 30 between the open position and the closed position.

As shown in FIGS. 2(A) to 2(C), each terminal 20 is made, for example by punching, while keeping a flat surface of sheet metal, and is arranged in the housing 10, with the terminal arrangement being orthogonal to a sheet surface of the sheet metal. The terminals 20 are attached in the terminal holding grooves 14 of the housing 10 towards an opposite direction to the direction of inserting the flat conductive member (pulling direction), i.e. leftward in FIGS. 2(A) to 2(C).

As shown in FIGS. 2(A) to 2(C), each of the terminals 20 has a support arm 21 that extends backward along the upper side part of the terminal holding groove 14 at an upper part in the terminal holding groove 14 and extends like an arm towards the movable member moving space 16; an extending arm portion 22 that extends backward along the lower part of the terminal holding groove 14 at a lower part of the terminal holding groove 14; a connecting section 23 that extends frontward and downward outside the housing 10; and a joining section 24 that extends in a vertical direction at a front part in the terminal holding groove 14 and joins a front end of the support arm 21, a front end of the extending arm portion 22 and a rear end of the connecting section 23.

A flexible front contact arm 25 extends backward above the extending arm portion 22 from the front end of the extending arm portion 22, and a flexible rear contact arm 26 extends frontward above the extending arm portion 22 from the rear end of the extending arm portion 22. According to the embodiment, as shown in FIGS. 2(A) to 2(C), the front contact arm 25 and the rear contact arm 26 are provided at substantially the same height level in the vertical direction. Furthermore, a section to be held 27 to be held in the housing 10 is formed to extend backward from the rear end of the extending arm portion 22.

The support arm 21 has at its rear end a concave rotary support section 21A, which is opened downward and is provided on a side of the movable member moving space 16. As will be described, the rotary support section 21A houses a shaft 32, which is a center of rotation of the pressing member 30 and freely rotatably support the shaft 32 upon rotation of the pressing member 30 between the open position and the closed position.

The connecting section 23 has a lower edge positioned slightly below a lower face of the bottom wall 11 of the housing 10, and is configured so as to be able to connect by soldering to a corresponding circuit section by contacting with the corresponding circuit section of a circuit board when the connector 1 is disposed on the circuit board (not illustrated). In addition, the joining section 24 is pressed into the terminal holding groove 14 at the upper and lower edges.

The front contact arm 25 extends to generally a center of the extending arm portion 22 in the front-and-back direction, and has a front contact section 25A for contacting with a corresponding circuit section on a lower face of the flat conductive member F, which is formed so as to protrude upward at the rear end of the front contact arm 25.

Moreover, the rear contact arm 26 extends frontward towards the front contact section 25A so as to be close to the front contact section 25A, and has a rear contact section 26A to contact with a corresponding circuit section on the lower face of the flat conductive member F, which is formed to protrude upward at the front end of the rear contact arm 26. As shown in FIGS. 2(A) to 2(C), the rear contact section 26A is provided behind the front contact section 25A but close to the front contact section 25A.

Generally, in a case of forming a protruding contact section at an end of a contact arm of a terminal that extends straight, the end of the contact arm including the contact section often has a generally triangular shape, for example, like the front contact section 25A in the embodiment.

On the other hand, as shown in FIGS. 2(A) to 2(C), the rear contact section 26A in the embodiment has a shape in which generally the right portion of the triangular shape is omitted. Therefore, according to the embodiment, the rear contact section 26A can be provided further closer to the front contact section 25A, so that the front contact section 25A and the rear contact section 26A can have complementary shapes to each other based on the partial omission of the triangular shape.

As shown in FIGS. 2(A) to 2(C) and also already described, the front contact arm 25 and the rear contact arm 26 extend in the front-and-back direction at substantially the same height level in the vertical direction. An end of the front contact arm 25 and an end of the rear contact arm 26 are provided at the same level in the vertical direction in the receiving space 15. There is space in the vertical direction between the front contact arm 25 or rear contact arm 26 and the extending arm portion 22, which thereby allows the front contact arm 25 and the rear contact arm 26 to elastically displace within range between the gaps.

According to the embodiment, the front contact arm 25 and the rear contact arm 26 are provided within range so as not to overlap with each other in the front-and-back direction. Therefore, by providing the front contact arm 25 and the rear contact arm 26 at the same height level in the vertical direction, it is possible to share the space in the vertical direction for elastic displacements of the front contact arm 25 and the rear contact arm 26. Therefore, it is possible to reduce the dimensions of the terminals 20 and in turn the connector 1 in the vertical direction, in comparison with a case where a plurality of contact arms are provided at different height levels in the vertical direction and therefore space is separately required to allow elastic displacement of each contact arm as in a conventional configuration.

The pressing member 30 functions as a pressing portion to press the flat conductive member F towards the front contact section 25A and the rear contact section 26A of each terminal 20. The pressing member 30 is configured to be able to rotate between an open position that enables insertion of the flat conductive member F upon extending in the vertical direction as shown in FIGS. 2(A) and (B), and a closed position that enhances the contact pressure of the flat conductive member F to the front contact section 25A and the rear contact section 26A of each terminal 20 upon extending in the front-and-back direction as shown in FIG. 2(C).

As shown in FIGS. 1(A) and 1(B), the pressing member 30 is formed to have a width to cover the arrangement range of the terminals 20 in the terminal arrangement direction. As shown in FIGS. 1(A), 2(A), and 2(B), the pressing member 30 has grooves 31, each of which is like a slit having a groove width that is slightly wider than the plate thickness of the terminal 20, and is formed at generally lower half part at the open position. Therefore, as shown in FIGS. 1(A) and 1(B), the generally lower half part of the pressing member 30 has a comb tooth-like appearance within the terminal arrangement range when viewed in the front-and-back direction. As shown in FIGS. 2(A) to 2(C), the grooves 31 allow entrance of the rotary support 21A of the terminal 20 from the front thereof.

As shown in FIGS. 2(A) and (B), the groove 31 has a shaft 32, which is separately formed like an island, near the lower end of the pressing member 30, and the facing walls of the groove 31 are joined with the shaft 32. The shaft 32 has a circular cross-sectional shape.

As shown in FIGS. 1(A) and 1(B), the pressing member 30 has an end shaft section 33, which protrudes from the both end surfaces that extend orthogonally to the terminal arrangement direction. Each of the end shaft sections 33 is formed coaxially with the shaft 32, and has a generally oval cross-sectional shape, which is partially cut away. As shown in FIGS. 1(A) and 1(B), each end shaft section 33 is housed in the end shaft housing section 13A of each side wall 13 of the housing 10 that is already described.

In addition, as shown in FIGS. 2(A) and 2(B), a rear face of the pressing member 30 in the closed position is formed as a pressing face 34 to press the flat conductive member F downward when the pressing member 30 is at the closed position (also see FIG. 2(C)).

The securing hardware 40 is made by punching sheet metal, and as shown in FIGS. 1(A) and 1(B), and is attached to a slit-like securing hardware holding groove 13B of the housing 10 from the rear side, with the sheet surface being orthogonal to the terminal arrangement direction. If a lower edge of the securing hardware 40 is connected by soldering to a circuit board, the connector 1 becomes secured onto the circuit board.

The connector 1 of the configuration may be assembled in the following manner. First, while keeping the pressing member at the closed position, dispose the pressing member 30 in the movable member moving space 16 so as to house the end shaft sections 33 of the pressing 30 within the end shaft housing sections 13A of the housing 10. With the arrangement, the pressing member 30 is brought below the position shown in FIGS. 2(A) to 2(C) by its own weight, more specifically, to a position where the end shaft sections 33 reach the bottoms of the end shaft housing sections 13A and become supported by the bottoms.

Then, pressing the terminals 20 from the front wall 12 side of the housing 10, to the terminal holding grooves 14 of the housing 10, i.e., leftward from the right side in FIGS. 2(A) to 2(C), attach the terminals 20 thereto. As a result, as shown in FIGS. 2(A) to 2(C), the joining sections 24 are pressed in the terminal holding grooves 14 at their upper and lower edges and the sections to be held 27 become pressed into the holding holes 11A-1, so that the terminals 20 are held within the terminal holding grooves 14.

As described above, the end shaft section 33 is on the bottom of the end shaft housing section 13A, so that the pressing member 30 is located below the position shown in FIGS. 2(A) to 2(C). Therefore, upon attaching the terminals 20 to the housing 10, it is possible to easily insert the rotary support 21A of each terminal into the groove 31 above the shaft 32 without interfering with the shaft 32 of the pressing member 20.

Thereafter, pressing the securing hardware 40 into the securing hardware holding groove 13B of the housing 10, attach the securing hardware 40 thereto. As a result of attachment of the securing hardware 40, an upper edge of the securing hardware 40 lifts the end shaft section 33 of the pressing member 30 from therebelow. Accordingly, the moving member 30 moves upward to the position shown in FIGS. 2(A) to 2(C), and thereby the shaft 32 becomes housed in the rotary supports 21A of the terminals 20, and thereby assembly of the connector 1 is completed.

Hereunder, referring to FIGS. 2(A) to 2(C), an operation of connecting the connector 1 to the flat conductive member F will be described. As shown in FIG. 2(A), the pressing member 30 is moved to the open position. Then, the flat conductive member F is inserted from the rear side to the front side so as to put into the receiving space 15 of the housing 10.

As shown in FIG. 2(B), the flat conductive member F is inserted to a regular position, where a front end face of the flat conductive member F contacts with a rear face of the front wall 12. According to the embodiment, having the pressing member 30 at the open position, it is possible to easily insert the flat conductive member F with no insertion force or small insertion force.

Next, pivotally moving the pressing member 30 in the open position, the pressing member 30 is moved to the closed position shown in FIG. 2(C). At the closed position, the pressing member 30 presses the flat conductive member F downward with its pressing face 34 towards the front contact sections 25A and the rear contact sections 26A of the terminals 20.

Therefore, as shown in FIG. 2(C), the front contact section 25A and the rear contact section 26A are pressed downward by the flat conductive member F to displace, and thereby the contact pressure between a corresponding circuit section, which is formed on a lower face of the flat conductive member F, and the front contact section 25A and the rear contact section 26A, is enhanced. Accordingly, by bringing the pressing member 30 to the closed position, connection between the connector 1 and the flat conductive member F is completed.

According to the embodiment, since the front contact section 25A and the rear contact section 26A are provided being close to each other, it is possible to make the contact pressure to the flat conductive member F substantially the same between the front contact section 25A and the rear contact section 26A, and thereby it is possible to improve the contact reliability.

In addition, according to the embodiment, the front contact sections 25A and the rear contact sections 26A are provided below the shaft 32 of the pressing member 30 and are close to the shaft 32 in the front-and-back direction. Since the shaft 32 is also a center of the pivotal movement of the pressing member 30, the displacement of the lower end portion (the right end portion in FIG. 2(C)), where the shaft 32 is provided in the pressing member 30 of FIGS. 2(A) and 2(B), in the vertical direction upon pivotal movement of the pressing member 30 is smaller than the displacements of other portion of the pressing member 30.

Therefore, even if unexpected external force to lift the flat conductive member F, i.e. external force that slightly pivotally moves the pressing member 30 in the closed position (the position shown in FIG. 2(C)) towards the open position (the positions shown in FIGS. 2(A) and 2(B)) acts on the pressing member 30, since the displacement of the portion, where the shaft 32 is provided, in the vertical direction is small, the pressing force to the flat conductive member F near the contact sections 25A and 26A provided near the shaft 32 is hardly influenced by the external force. As a result, since high contact pressure between the flat conductive member F and the contact sections 25A and 26A is stably maintained, it is possible to improve the contact reliability.

Furthermore, according to the embodiment, the rear contact section 26A is provided behind the shaft 32 and the front contact section 25A is provided in front of the shaft 32. Therefore, as shown in FIG. 2(C), when the pressing member 30 is at the closed position, the reaction force towards the pressing member 30 to the pressing force that the rear contact section 26A receives from the pressing member 30 via the flat conductive member F acts on the pressing member 30 in the direction of the pivotal movement of the pressing member 30 towards the open position, i.e. clockwise in FIG. 2(C).

On the other hand, the reaction force to the pressing member 30 to the pressing force that the front contact section 25A receives from the pressing member 30 via the flat conductive member F acts on the pressing member 30 in the direction to keep the pressing member 30 at the closed position, i.e. counterclockwise in FIG. 2(C). Therefore, since the direction of the pivotal movements for those reaction force to act are opposite, they offset each other, and thereby the pressing member 30 stably stays at the closed position, the contact pressures between the flat conductive member F and the contact sections 25A and 26A are stably maintained, and thereby it is possible to improve the contact reliability.

In the embodiment, the front contact arm and the rear contact arm are provided at the same height level in the vertical direction. However, the positions to provide those contact arms do not have to be the same height level in the vertical direction. For example, the contact arms may be provided to be slightly staggered partially overlapping in the vertical direction, or may be provided close to each other in the vertical direction without overlapping. Even if the contact arms are provided at such positions, similarly to the embodiment, it is still possible to form one space (gap) between the contact arms and the extending arm portion so as to allow the elastic displacement of the contact arms, and it is possible to reduce dimensions of the terminals and connector in the vertical direction.

According to the embodiment, the pressing member 30 attached to the housing is provided as the pressing portion. Alternatively, without providing the pressing member 30, the housing 10 may be modified to have the pressing portion as a modified example.

Figure 9:
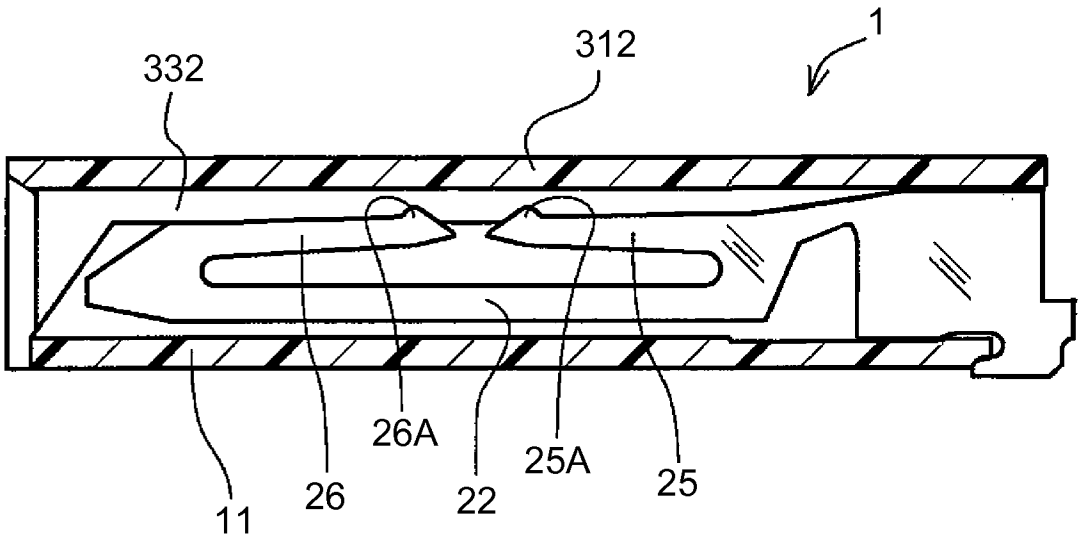
FIG. 9 is a vertical sectional view showing a modified example of the electrical connector for the flat conductive member according to the first embodiment of the present invention.

FIG. 9 is a vertical sectional view showing the modified example of the electrical connector 1 for the flat conductive member F according to the first embodiment of the present invention. As shown in FIG. 9, for example, it is possible to configure such that a receiving space may be formed between an upper wall 312 and the bottom wall 11, which face each other in the vertical direction in the housing 10. The upper wall 312 has a protruding portion 332 protruding downwardly. Further, it is configured such that a distance between the contact sections 25A and 26A of the terminals and the protruding portion 332 of the upper wall 312 in the receiving space is set smaller than a thickness of the flat conductive member F.

According to the connector 1 with the configuration described above, when the flat conductive member F is inserted in the receiving space, the contact sections 25A and 26A press the flat conductive member F towards the protruding portion 332 of the upper wall 312. Accordingly, a reaction force from the protruding portion 332 of the upper wall 312 presses the flat conductive member F towards the contact sections 25A and 26A, thereby exerting a contact pressure between the flat conductive member F and the contact sections 25A and 26A.

In the connector 1 with the configuration, the protruding portion 332 of the upper wall 312 functions as the pressing portion for pressing the flat conductive member F toward the contact sections 25A and 26A.

According to the embodiment, each terminal has two contact sections, but the number of the contact sections may not be have to be two and it is possible to provide three or more contact sections. For example, there may be provided three contact sections by forming each terminal, which includes a straight section that extends further backward from a rear end of the extending arm portion of the terminal shown in FIGS. 2(A) to 2(C) and a contract arm of the same shape as the rear contact arm, which extends from the rear end of the straight section to near the rear contact arm.

Second Embodiment

A second embodiment of the present invention will be explained next. Since the terminals are attached to a connector from the backside, the connector of the embodiment differs from the connector of the first embodiment, in which the terminals are attached to the connector from the front side. Since the basic configuration of the connector in the embodiment is the same as the configuration of the connector in the first embodiment, the configurations of the housing and the terminals will be mainly discussed and the same portions as in the first embodiment are indicated with the same reference numerals but adding "100" to the numerals used in the first embodiment and explanation is omitted.

Figure 3:
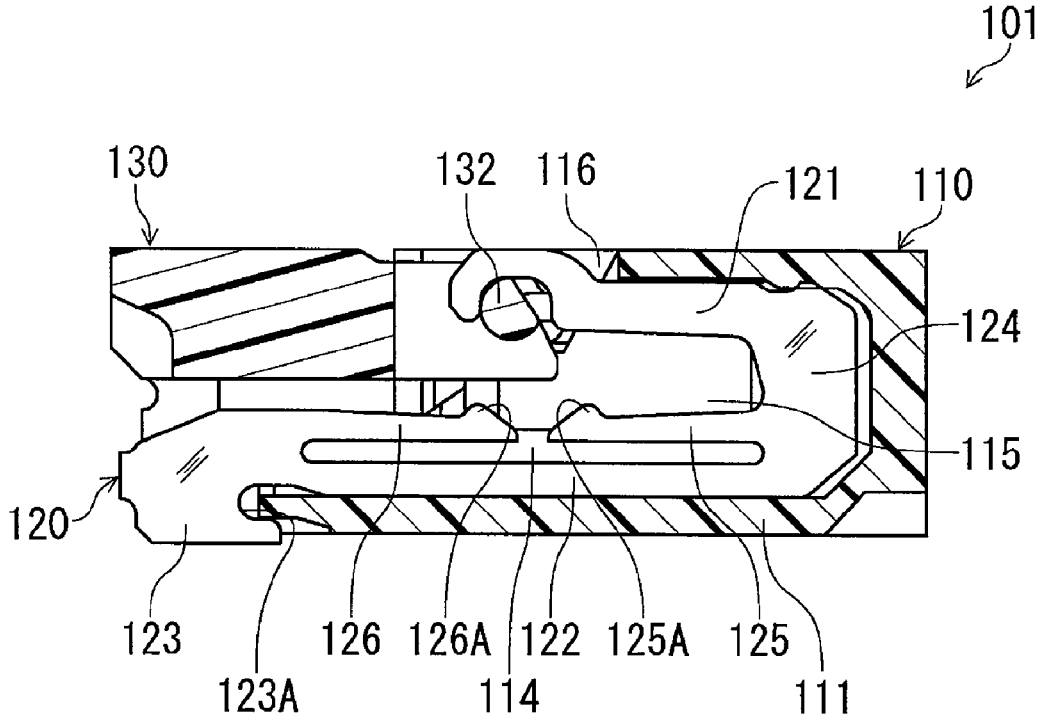
FIG. 3 is a vertical sectional view showing an electrical connector for a flat conductive member according to a second embodiment of the present invention.

FIG. 3 is a vertical sectional view showing an electrical connector 101 for a flat conductive member F according to the second embodiment of the present invention.

As shown in FIG. 3, terminal holding grooves 114 of a housing 110 of a connector 101 are formed so as to be open on the backside, and are not provided through in the front-and-back direction.

Each of the terminals 120 includes a support arm 121, which extends backward in an upper part inside the terminal holding groove 114 and then extends like an arm towards the movable member moving space 116; an extending arm portion 122, which extends backward in a lower portion of the terminal holding groove 114; a connecting section 123, which extends backward from the rear end of the extending arm portion 122 to outside of the housing 110; a joining section 124, which extends in the vertical direction in a front side portion of the terminal holding groove 114 and joins between the front end of the support arm 121 and the front end of the extending arm portion 122.

A flexible front contact arm 125 extends backward above the extending arm portion 122 from the front end of the extending arm portion 122, and a flexible rear contact arm 126 extends frontward above the extending arm portion 122 from the rear end of the extending arm portion 122. The front contact arm 125 and the rear contact arm 126 are provided at substantially the same height level in the vertical direction.

Each connecting section 123 has at its front edge a fitting section 123A to fit to a rear edge of the bottom wall 111 of the housing 110, those fitting sections 123A are formed as recesses that are opened at their front side.

Upon assembling the connector 101, each terminal 120 is attached being pressed into the terminal holding groove 114 from the rear side. As a result, as shown in FIG. 3, an upper edge and a lower edge of each joining section 124 are pressed in the terminal holding groove 114, and the fitting section 123A fits into the rear edge of the bottom wall 111 of the housing 110, so that the terminal 120 becomes held within the terminal holding groove 114.

Third Embodiment

Figure 4:
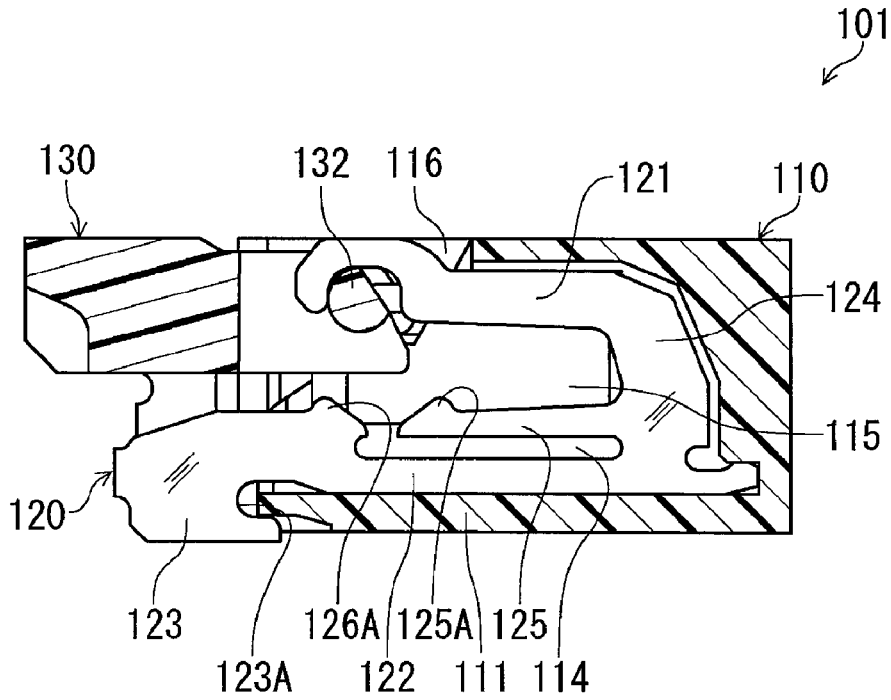
FIG. 4 is a vertical sectional view showing an electrical connector for a flat conductive member according to a third embodiment of the present invention.

A third embodiment of the present invention will be explained next. The terminals 120 are not limited to the embodiment shown in FIG. 3, and there may be various modifications and alterations. FIG. 4 is a vertical sectional view showing the electrical connector 101 for the flat conductive member F according to the third embodiment of the present invention.

As shown in FIG. 4, it may be possible to omit the rear contact arm 126 and form the rear contact section 126A to protrude upward from the rear end of the extending arm portion 122. In the embodiment, the front contact arm 125 and the front contact section 125A are provided at the same height level as the rear contact section 126A in the vertical direction, and thereby the dimensions of the terminals 120 and the connector 101 in the vertical direction are reduced. In addition, since the rear contact arm 126 is omitted, it is also possible to reduce the dimensions of the terminals 120 and the connector 101 in the front-and-back direction.

Fourth Embodiment

Figure 5:
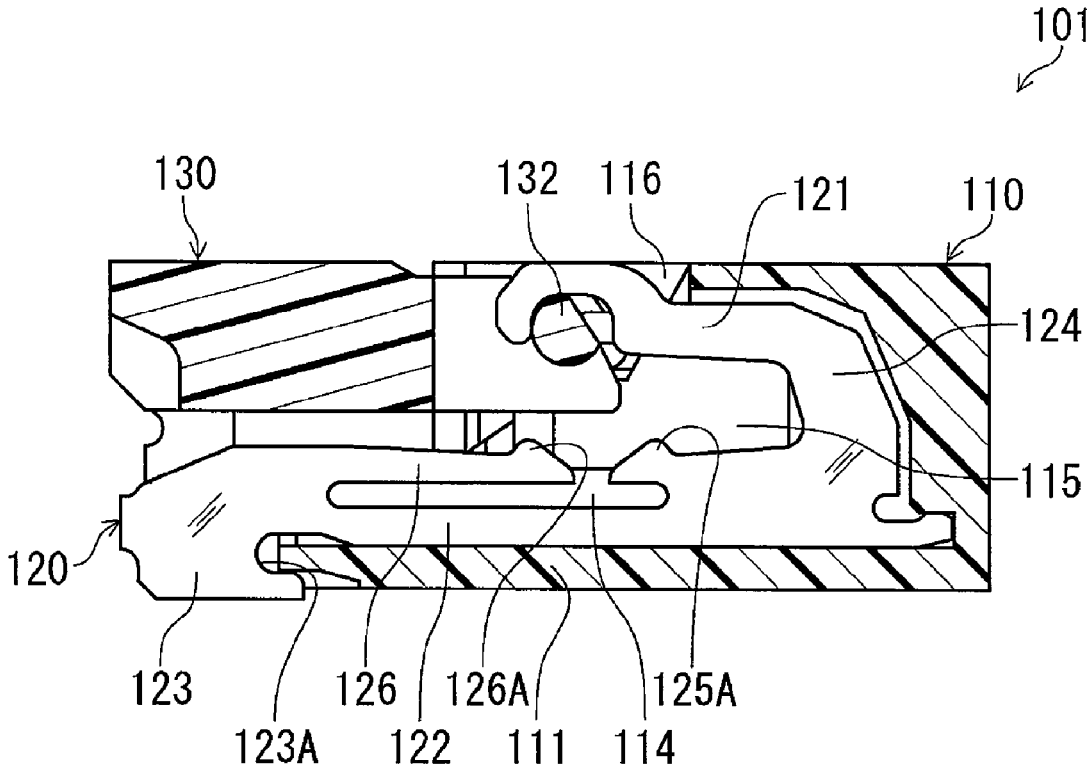
FIG. 5 is a vertical sectional view showing an electrical connector for a flat conductive member according to a fourth embodiment of the present invention.

A fourth embodiment of the present invention will be explained next. FIG. 5 is a vertical sectional view showing the electrical connector 101 for the flat conductive member F according to the fourth embodiment of the present invention.

As shown in FIG. 5, it is also possible to omit the front contact arm 125 and form the front contact section 125A so as to protrude upward from the front end of the extending arm portion 122. In the embodiment, the rear contact arm 126 and the rear contact section 126A are provided at the same height level as the front contact section 125A in the vertical direction and thereby the dimensions of the terminals 120 and the connector 101 are reduced in the vertical direction. Furthermore, since the front contact arm 125 is omitted, it is also possible to reduce the dimensions of the terminals 120 and the connector 101 in the front-and-back direction. Moreover, it is also possible to arrange those terminals of the fourth embodiment and the terminals of the first embodiments alternately.

Fifth Embodiment

Figure 6:
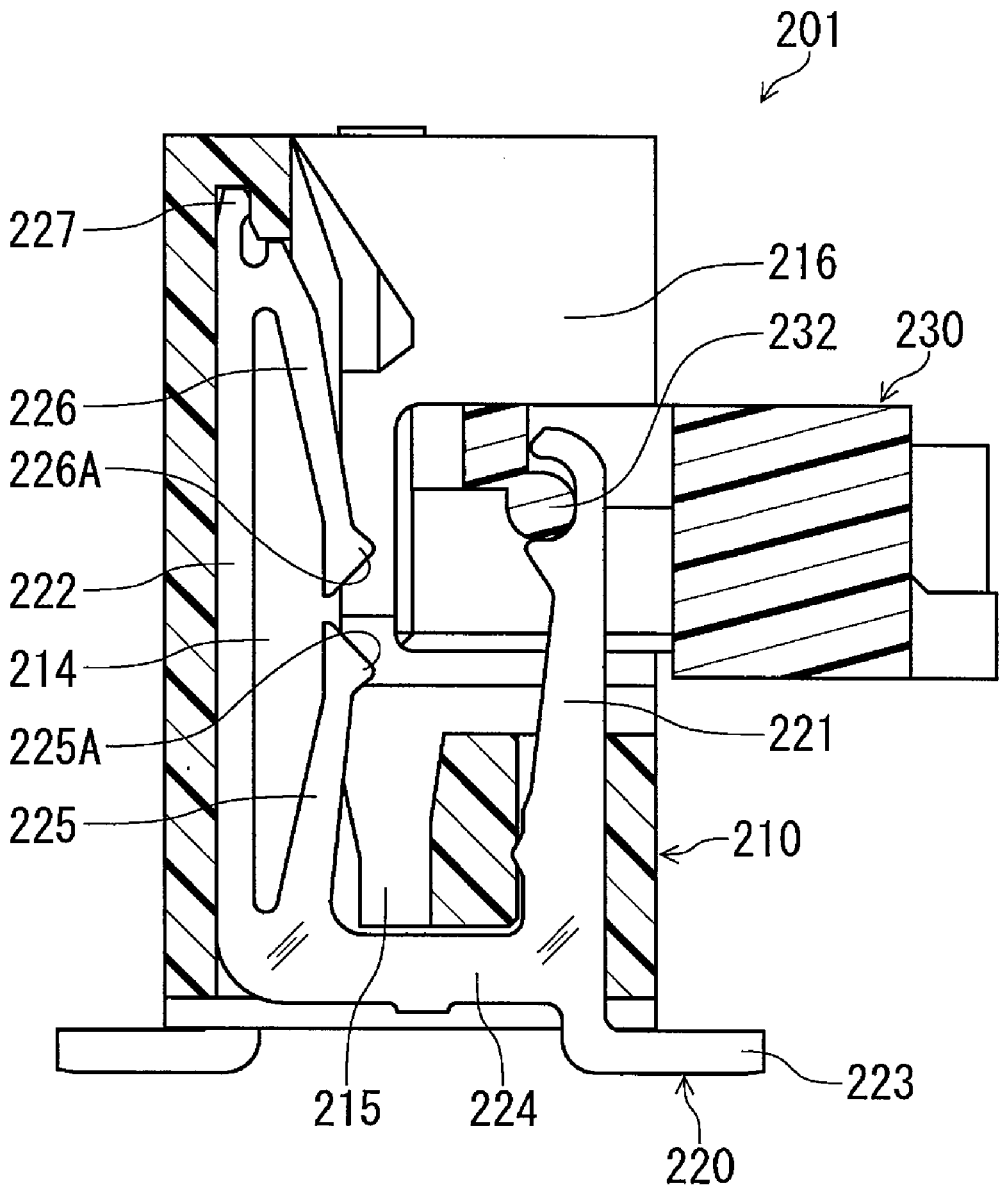
FIG. 6 is a vertical sectional view showing an electrical connector for a flat conductive member according to a fifth embodiment of the present invention.

A fifth embodiment of the present invention will be explained next. FIG. 6 is a vertical sectional view showing an electrical connector 201 for the flat conductive member F according to the fifth embodiment of the present invention.

Since the connector of the embodiment is configured to attach onto a circuit board so as to insert the flat conductive member in a direction vertical to the circuit board, the connector according to the embodiment has a different configuration from the first embodiment, which is attached to a circuit board so as to insert a flat conductive member in a direction parallel to the circuit board. Since the basic configuration of the connector in the embodiment is the same as the configuration of the connector in the first embodiment, the configurations of the housing and the terminals will be mainly described and the same portions as in the first embodiment are indicated with the same reference numerals but adding "200" to the numerals used in the first embodiment and explanation will be omitted.

FIG. 6 is the vertical sectional view of the connector 201, which is taken at a position of a terminal. In the figure, a pressing member 230 is provided at the closed position. The connector 201 according to the embodiment is a type of connector, in which a flat conductive member is inserted from thereabove, as if the connector 1 of the first embodiment were placed vertically, so that the receiving space is opened upward. In other words, according to the embodiment, the lower part is the front part (insertion destination side) in the direction of inserting the flat conductive member.

As shown in FIG. 6, each terminal 220 includes a support arm 221, which extends upward on the right side in the terminal holding groove 214 and then extends like an arm towards the movable member moving space 216; the extending arm portion 222, which extends upward on the left side in the terminal holding groove 214; a connecting section 223 that extends rightward from a lower part of the support arm 221 towards outside the housing 210; and a joining section 224, which laterally extends at a lower part in the terminal holding groove 214 and joins a lower end of the support arm 221, a lower end of the extending arm portion 222 and the upper end of the connecting section 223.

In the terminal holding groove 214, a flexible front connecting arm 225 extends upward from a lower end of the extending arm portion 222 and a flexible rear contact arm 226 extends downward from an upper end of the extending arm portion 222. As shown in FIG. 6, the front contact arm 225 and the rear contact arm 226 extend diagonally rightward, i.e. towards the receiving space 215. The front contact arm 225 is provided generally right below the rear contact arm 226 in a direction parallel to the extending direction of the extending arm portion 222. In addition, a section to be held 227, which is to be held by the housing 210, protrudes upward from the upper end of the extending arm portion 222.

The front contact arm 225 extends to generally the center of the extending arm portion 222 in the vertical direction, and has a front contact section 225A to contact with a corresponding circuit section of the flat conductive member F, which protrudes rightward from the upper end of the front contact arm 225 towards inside of the receiving space 215. In addition, the rear contact section 226A to contact with the corresponding circuit section of the flat conductive member F is formed to protrude rightward from the lower end of the rear contact arm 226 towards inside of the receiving space 215.

According to the embodiment, the front contact arm 225 is provided generally right below the rear contact arm 226 when viewed in a direction parallel to the extending direction of the extending arm portion 222, and thereby the dimensions of the terminals 220 and in turn the connector are reduced in the lateral direction.

Sixth Embodiment

Figure 7:
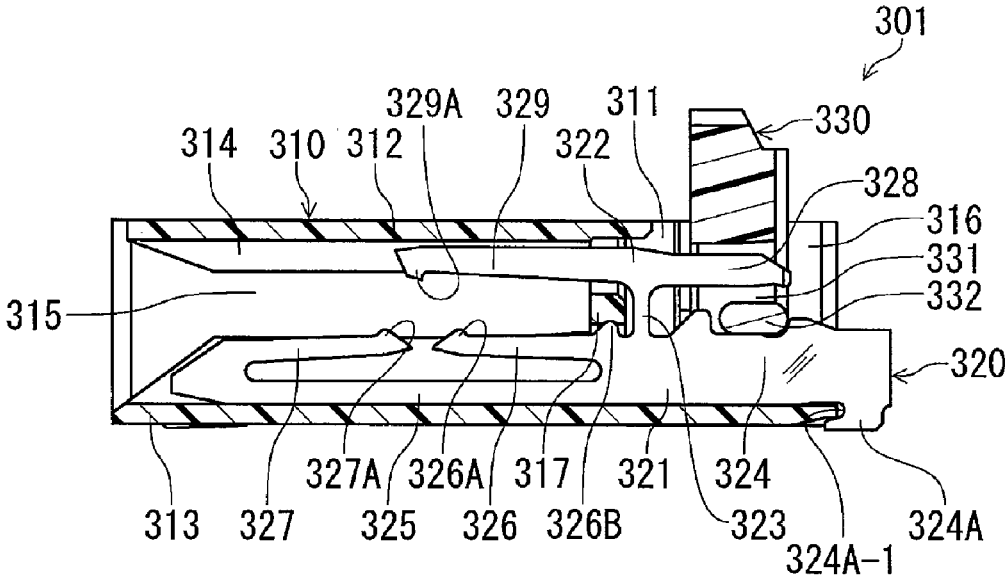
FIG. 7 is a vertical sectional view showing an electrical connector for a flat conductive member according to a sixth embodiment of the present invention.

A sixth embodiment of the present invention will be explained next. FIG. 7 is a vertical sectional view showing an electrical connector 301 for the flat conductive member F according to the sixth embodiment of the present invention.

Since a pressing member is composed of a pressing section, which is a part of a terminal, the connector of the embodiment differs from the first embodiment, in which the pressing member is composed of the pressing member.

In the embodiment, once a movable member, which will be described later, is pivotally moved from the open position to the closed position, a pressing arm, which has a pressing section formed on a terminal as a pressing member, presses a flat conductive member towards the contact section by action of a cam shaft of the movable member.

Hereunder, detailed configuration of the connector 301 in the embodiment will be described. The connector 301 includes a housing 310 that is generally rectangular, terminals 320 that are to be arranged and held in the housing 310, and a movable member 330 that is supported so as to be able to freely pivotally move between the housing 310 and the terminals 320 between the open position and the closed position.

The housing 310 is provided through in the front-and-back direction at the positions of the terminals 320 along the terminal arrangement direction (a direction orthogonal to the paper surface of FIG. 7), and have slit-like grooves that extend in directions parallel to the paper surface. There are provided dividing walls 311 between the adjacent grooves in the terminal arrangement direction, which extend in the vertical direction at a position close to the front side. In each groove, a portion that extends over the upper wall 312, dividing walls 311, and the bottom wall 313, is formed as a terminal holding groove 314.

The groove has space, which is provided through a part behind the diving wall 311 between the upper wall 312 and the bottom wall 313 along the terminal arrangement direction and is opened on the rear side, as receiving space 315. In addition, the groove has its upper half portion in front of the dividing wall 311 be provided through in the terminal arrangement direction and be opened upward as open space, and the open space composes a movable member moving space 316 to allow movement of the movable member 330 between the open position and the closed position.

On each dividing wall 311, there is formed like an island, a terminal holding section 317 near the left side of the middle part in the vertical direction. The terminal holding section 317 joins facing wall surfaces of the dividing wall 311.

Each terminal 320 is made by punching sheet metal while keeping its sheet surface, and includes a stationary arm portion 321, which extends in the front-and-back direction along the lower portion of the terminal holding groove 314; a movable arm portion 322, which extends in the front-and-back direction along the upper portion of the terminal holding groove 314; and a joining section 323, which extends in the vertical direction and joins the stationary arm portion 321 and the movable arm portion 322 at the middle position in the front-and-back direction.

The stationary arm portion 321 is secured onto the housing 310, and has a support section 324 to support a cam shaft section 332 of the movable member 330, which will be described below, from therebelow near the front end side in comparison with the joining section 323. The support section 324 supports the cam shaft section 332 with its recess formed on an upper edge from therebelow so as to be able to pivotally move.

A connecting section 324A extends downward from a front end of the support section 324. The connecting section 324A has its lower edge slightly lower than a lower face of the bottom wall 313 of the housing 310. When the connector 1 is disposed on a circuit board (not illustrated), the connecting section 324A contacts with a corresponding circuit section of the circuit board and can be connected by soldering to the corresponding circuit section. In addition, there is a fitting section 324A-1, which fits to a front edge of the bottom wall 313 and is formed at the rear edge of the connecting section 324A so as to be opened backward.

In the stationary arm portion 321, a portion closer to the rear end side than the joining section 323 has a similar shape to those of the extending arm portion 22, the front contract arm 25, and the rear contact arm 26 in the first embodiment.

More specifically, a front contact arm 326 extends backward from a front end of the extending arm portion 325, which extends straight in the front-and-back direction along a lower part of the terminal holding groove 314, and a rear contact arm 327 extends frontward from a rear end.

As shown in FIG. 7, the front contact arm 326 and the rear contact arm 327 are provided at substantially the same height level in the vertical direction. With the front contact section 326A and the rear contact section 327A, which are respectively formed on an end of each contact arm, it is possible to connect with a corresponding circuit section on a lower face of the flat conductive member. Furthermore, on a basal part of the front contact arm 326, a holding protrusion 326B to hold each terminal 320 in the terminal holding groove 314 protrudes upward.

As such, also in the embodiment, since the front contact arm 326 and the rear contact arm 327 are provided at the same positions in the vertical direction, similarly to the first embodiment, it is possible to reduce the dimensions of the terminals 320 and in turn the connector 301 in the vertical direction.

The movable arm portion 322 of each terminal 320 has a pressed section 328, which is pressed by a cam shaft section 332 of the movable member 330 as will be described, at a position that is closer to the front end side than the joining section 323, and a pressing arm 329, which has a protrusion-like pressing section 329A as a pressing member to press the flat conductive member downward as will be described, at a position closer to the rear end side than the joining section 323.

The pressed section 328 extends like an am from inside of the terminal holding groove 314 towards the movable member moving space 316, and is designed to be pressed from the cam shaft section 332 at its lower edge. In addition, the pressing arm 329 extends in the terminal holding groove 314 in the front-and-back direction and has a pressing section 329A formed at the rear end so as to protrude downward into the receiving space 315.

As shown in FIG. 7, the pressing section 329A is provided between the front contact section 326A and the rear contact section 327A in the front-and-back direction, and is designed to press the flat conductive member downward towards the front contact section 326A and the rear contact section 327A when the movable member 330 is moved to the closed position. As such, since the pressing section 329A is provided between the front contact section 326A and the rear contact section 327A in the front-and-back direction, it is possible to make the distances from the position to press the flat conductive member by the pressing section 329A to the front contact section 326A to the rear contact section 327A generally the same. Therefore, it is possible to make the contact pressure to the flat conductive member from the front contact section 326A and the rear contact section 327A generally the same and thereby it is possible to enhance the contact reliability.

The movable member 330 is configured to be able to pivotally move between the open position, which enables insertion of the flat conductive member, and the open position, which enhances the contact pressure of the flat conductive member to the front contact section 326A and the rear contact section 327A of the terminal 320.

FIG. 7 shows a state where the movable member 330 is at the open position. The movable member 330 has generally the same shape as that of the pressing member 30 in the first embodiment. More specifically, the movable member 330 has a slit-like groove 331 formed like an island near generally lower half portion of the movable member 330 at the open position as shown in FIG. 7, and the facing walls of the groove 331 are joined by the island-like cam shaft section 332 formed near a lower end of the movable member 330. As shown in FIG. 7, the groove 331 allows entrance of the pressed section 328 of the terminal 320 from the backside and the pressed section 328 is provided above the cam shaft section 332.

As shown in FIG. 7, when the movable member 330 is at the open position, the cam shaft section 332 has a laterally elongated sectional shape. The dimension in the short axial direction (a vertical direction in FIG. 7) of the cam shaft section 332 is smaller than the distance between the pressed section 328 and the support section 324 in the vertical direction, and the dimension in the longer axial direction (a lateral direction in FIG. 7) is slightly larger than the aforementioned distance.

Therefore, when the movable member 330 is at the open position, as shown in FIG. 7, there is formed a gap in the vertical direction between the cam shaft section 332 and the pressed section 328. Once the movable member 330 is brought to the closed position by about 90 degrees of clockwise pivotal movement in FIG. 7 from the open position, the cam shaft section 332 becomes elongated in the vertical position, and the upper end at the closed position (the left end at the open position in FIG. 7) presses the lower edge of the pressed section 328 upward.

The connector 301 of the configuration may be assembled as follows. First, attach the terminals 320 to the housing 310 by inserting from the front side of the housing 310, i.e. right side in FIG. 7, towards the rear side so as to press into the terminal holding grooves 314 of the housing 310. As a result, as shown in FIG. 7, the holding protrusion 326B become engaged onto a lower face of the terminal holding grooves 317 of the housing 310 and the fitting section 324A-1 fit to the front edge of the bottom wall 313 of the housing 310, and thereby the terminals 320 are held in the terminal holding grooves 314.

Next, while keeping the movable member 330 at the closed position, moving the cam shaft section 332 of the movable member 330 from the rear side in between the pressed section 328 of the terminal 320 and the support section 324, attach the movable member 330 thereto. With the procedure like this, assembly of the connector 301 can be completed.

Hereunder, operation of connecting between the connector 301 and the flat conductive member will be described referring to FIG. 7. First, as shown in FIG. 7, bring the movable member 330 to the open position. Then, insert the flat conductive member from the backside to the front side so as to be into the receiving space 315 of the housing 310. The flat conductive member is inserted to a regular position, where the front end face contacts with a rear face of the dividing wall 311.

Thereafter, pivotally move the movable member 330 at the open position to the closed position. As the movable member 330 moves to the closed position, the cam shaft section 332 of the movable member 330 pivotally moves and the cam shaft section 332 presses the pressed section 328 of the terminal 320 upward, and thereby the movable arm portion 322 of the terminal 320 pivotally displaces for certain angle with the joining section 323 being as a fulcrum. As a result, the pressing arm 329 displaces downward, and thereby the pressing section 329A provided at the rear end of the pressing arm 329, presses the flat conductive member downward towards the front contact section 326A and the rear contact section 327A.

At the closed position, the front contact section 326A and the rear contact section 327A displaces being pressed downward by the flat conductive member, and as a result, the contact pressure between the corresponding circuit section of the flat conductive member and the front contact section 326A or the rear contact section 327A become enhanced. Moving the movable member 330 to the closed position as described above, it is possible to complete the connection between the connector 301 and the flat conductive member.

Seventh Embodiment

Figure 8:
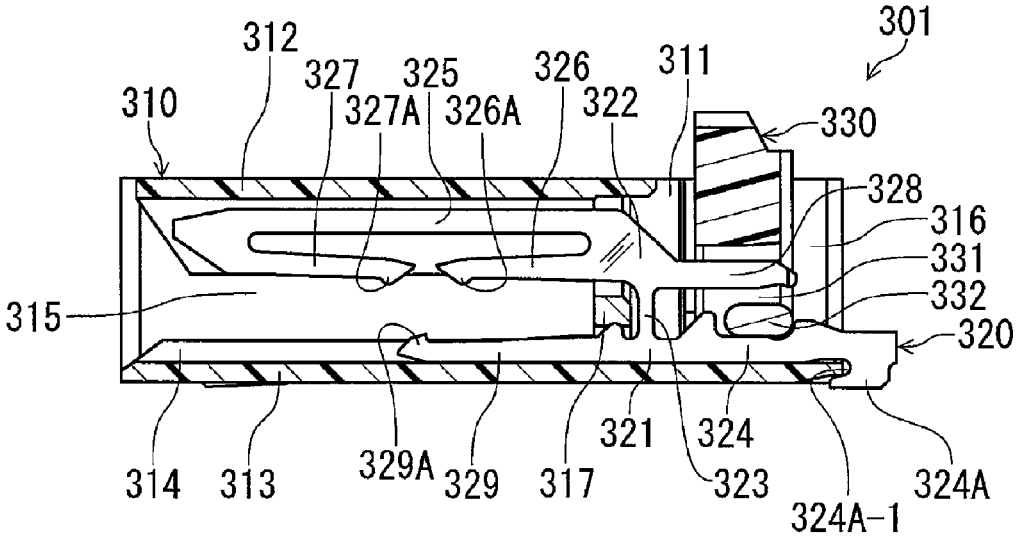
FIG. 8 is a vertical sectional view showing an electrical connector for a flat conductive member according to a seventh embodiment of the present invention.

A seventh embodiment of the present invention will be explained next. FIG. 8 is a vertical sectional view showing an electrical connector 301 for the flat conductive member F according to the seventh embodiment of the present invention.

Since a stationary arm portion has a pressing arm formed thereto, and a movable arm portion has an extending arm portion formed thereto, a front contact arm and a rear contact section formed thereon in each terminal, the connector in the embodiment differs from the connector shown in FIG. 7, in which the movable arm portion has the pressing arm and the stationary arm portion has the extending arm portion, the front contact arm, and the rear contact section.

Since the connector according to the embodiment is basically configured similarly to the connector of FIG. 7 except the physical relations between the pressing arm and the extending arm portion and between the front contact arm and the rear contact section, the extending arm portion, the front contact arm, the rear contact section, and the pressing arm will be mainly described and the same portions as in the connector of FIG. 7 will be indicated with the same reference numerals in FIG. 7 and the explanation will be omitted. Furthermore, in the embodiment, a corresponding circuit section of the flat conductive member is formed on an upper face of the flat conductive member.

As shown in FIG. 8, each terminal 320 of the connector 301 according to the embodiment has a shape as if a rear-side part behind a joining section 323 of the terminal 320 in the connector of FIG. 7 were inversed in the vertical direction. More specifically, a stationary arm portion 321 has a pressing arm 329 formed thereon, and a movable arm portion 322 has an extending arm portion 325, a front contact arm 326, and a rear contact arm 327.

If the movable member 330 is brought to the closed position after insertion of a flat conductive member into the connector 301, a cam shaft section 332 presses a pressed section 328 of the terminal 320 upward, and thereby the movable arm portion 322 pivotally displaces for a certain angle. As a result, the extending arm portion 325, the front contact arm 326, and the rear contact arm 327 displace downward, and thereby the front contact section 326A and the rear contact section 327A press the flat conductive member downward towards the pressing section 329A of the pressing arm 329, and contact with the corresponding circuit section on an upper face of the flat conductive member.

As such, pressing the flat conductive member towards the pressing section 329A, the pressing section 329A presses the flat conductive member upward towards the front contact section 326A and the rear contact section 327A by a reaction force. As a result, the contact pressure between the corresponding circuit section of the flat conductive member and the front contact section 326A or the rear contact section 327A becomes enhanced, and the connection between the connector 301 and the flat conductive member is completed.

The disclosure of Japanese Patent Application No. 2010-073505, filed on Mar. 26, 2010 is incorporated in the application by reference.

While the invention has been explained with reference to the specific embodiments of the invention, the explanation is illustrative and the invention is limited only by the appended claims.

What is claimed is:

1. An electrical connector for connecting a flat conductive member, comprising:

a housing including a receiving section for receiving the flat conductive member in a first direction;

a terminal arranged in the housing, said terminal including a first contact section for contacting with the flat conductive member, a second contact section for contacting with the flat conductive member, an extending arm portion, and a first flexible contact arm portion extending from the extending arm portion toward the second contact section, said first contact section being disposed at a distal end portion of the first flexible contact arm portion; and a pressing portion for contacting the flat conductive member with the first contact section and the second contact section, wherein said extending arm portion is arranged to extend in parallel to the flat conductive member and be situated further away from the flat conductive member relative to the first contact section and the second contact section when the flat conductive member is inserted into the housing.

2. The electrical connector according to claim 1, wherein said first flexible contact arm portion is situated at a position same as that of the second contact section in a second direction perpendicular to the first direction.

3. The electrical connector according to claim 1, further comprising a second flexible, contact arm portion extending from the extending arm portion toward the first contact section, said second contact section being disposed at a distal end portion of the second flexible contact arm portion.

4. The electrical connector according to claim 1, wherein said pressing portion is arranged to contact the flat conductive member with the first contact section and the second contact section at a position between the first contact section and the second contact section in the first direction.

5. The electrical connector according to claim 1, wherein said pressing portion is arranged to move between an open position for inserting the flat conductive member and a closed position for pressing the flat conductive member.

6. The electrical connector according to claim 5, wherein said pressing portion includes a cam section.

7. The electrical connector according to claim 6, wherein said terminal further includes a stationary arm portion extending in the first direction, a movable arm portion extending in the first direction in parallel to the stationary arm portion, and a joint section for joining the stationary arm portion and the movable arm portion, said stationary arm portion fixed to the housing and including a third contact section and a support section for supporting the cam section, said movable arm portion including a pressed section and a pressing section so that the cam section presses the pressed section to deform the movable arm portion and the pressing section presses the flat conductive member against the third contact section when the pressing portion moves from the open position to the closed position.

8. The electrical connector according to claim 6, wherein said terminal further includes a stationary arm portion extending in the first direction, a movable arm portion extending in the first direction in parallel to the stationary arm portion, and a joint section for joining the stationary arm portion and the movable arm portion, said stationary arm portion fixed to the housing and including a pressing section and a support section for supporting the cam section, said movable arm portion including a pressed section and a third contact section so that the cam section presses the pressed section to deform the movable arm portion and the pressing section presses the flat conductive member against the third contact section when the pressing member moves from the open position to the closed position.

* * * * *